US012704363B1

(12) United States Patent
Brunn et al.

(10) Patent No.: US 12,704,363 B1
(45) Date of Patent: Aug. 11, 2026

(54) NON-DESTRUCTIVE PROJECTILE RECOVERY

(71) Applicant: U.S. Government as Represented by the Secretary of the Army, Picatinny Arsenal, NJ (US)

(72) Inventors: Joshua F. Brunn, Picatinny Arsenal, NJ (US); Robert M. Kim, Picatinny Arsenal, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 19/229,261

(22) Filed: Jun. 5, 2025

(51) Int. Cl.
*F42B 33/06* (2006.01)

(52) U.S. Cl.
CPC ..... *F42B 33/062* (2013.01)

(58) Field of Classification Search
CPC ..... F42B 33/062
USPC ..... 86/49
See application file for complete search history.

(56) References Cited

U.S. PATENT DOCUMENTS

| | | | |
|---|---|---|---|
| 2,552,772 | A | 5/1951 | Fasig |
| 2,828,663 | A | 4/1958 | Andrade |
| 2,970,508 | A | 2/1961 | Wicks |
| 3,123,369 | A | 3/1964 | Jacobsen |
| 3,174,389 | A | 3/1965 | Davis |
| 3,646,661 | A | 3/1972 | Ashbrook |
| 3,898,908 | A | 8/1975 | Isenhower et al. |
| 4,005,630 | A | 2/1977 | Patrick |
| 5,490,313 | A | 2/1996 | Ashbrook |
| 7,225,716 | B1 | 6/2007 | Miller et al. |
| 7,568,417 | B1 | 8/2009 | Lee |
| 8,371,903 | B2 | 2/2013 | Goetsch et al. |
| 11,274,900 | B2 | 3/2022 | Schmit et al. |
| 12,460,913 | B2 * | 11/2025 | Thomalla ..... F42D 5/04 |

OTHER PUBLICATIONS

JP 2004003741 A1 and English Translation (Year: 2004).*
JP 3565769 B2 and English Translation (Year: 2004).*
"Demilitarization", Gradient Technology, https://gradtech.com/demilitarization/#demilitarizationtechnologydevelopment (copy accessed Nov. 20, 2024).
"Live Ammunition Cut in Half with Waterjet", Waterjet Channel, https://www.youtube.com/watch?v=iZCLZ1wZMZ4 (published May 3, 2019, last visited Nov. 20, 2024).

* cited by examiner

*Primary Examiner* — Reginald S Tillman, Jr.
(74) *Attorney, Agent, or Firm* — David J. Torrente

(57) ABSTRACT

A method and apparatus for the intact recovery of ammunition projectiles. A high pressure fluid cutting device severs the casing of the ammunition cartridge, rearward on the cartridge beyond the rearward extent of the projectile. An automated feeding apparatus collects, orients, and feeds the first halves so severed to a separation press. The separation press includes a press ram, and a brace block. The brace block has a through opening sized to pass the projectile without alteration, and an internal side wall engaging the first half by the portion of the casing. The method includes a pressing force applied to the first half by contacting a rearward extent of the projectile, until the projectile separates from the portion of the casing.

16 Claims, 5 Drawing Sheets

-PRIOR ART-

NON-DESTRUCTIVE PROJECTILE RECOVERY

STATEMENT OF GOVERNMENT INTEREST

The inventions described herein may be manufactured, used and licensed by or for the United States Government.

BACKGROUND OF THE DISCLOSURE

Field of the Disclosure

The instant disclosure relates to the field of armaments and ammunition, and more particularly to a method and apparatus for the non-destructive demilitarization of certain ammunition cartridges that enables and promotes the recovery of certain components for their reuse.

Brief Description of Related Art

Referring to prior art FIG. 6, across many various calibers of firearm ammunition, an ammunition cartridge 10 can include a certain number of common characteristics. An ammunition cartridge 10 can include a projectile 12 which is expelled by the firearm towards a target. Projectile 12 may be one of several types, materials and/or characteristics. The projectile 12 is secured to a casing 14 of the cartridge 10. The casing 14 is typically generally cylindrical, and encloses a cavity 16 within. The casing 14 secures the projectile 12, the latter serving to close an open end 18 of the casing 14. To initiate firing of the cartridge 10, a percussive force is applied to a primer 20, by what is typically called a firing pin, causing the primer 20 to generate a spark. That spark ignites propellant placed within the cavity 16. The gases generated by the combustion of the propellant expel the projectile 12 from the casing 14, and ultimately from the firearm itself. Certain calibers of ammunition include a shoulder 22 as part of the cartridge, to help seat the casing 14 within the firing chamber of the firearm.

The manufacturing process for creation of ammunition produces a certain and non-negligible proportion of waste via rejected ammunition cartridges. The waste cartridges are considered hazardous material, to the extent that they include the propellant and/or a primer. Disposal of such hazardous material is expensive and environmentally deleterious, and the volume of such hazardous waste should therefore be minimized.

A number of techniques have been proposed to deal with waste cartridges. These techniques all suffer from at least one of two major drawbacks. In a first aspect, certain known large-scale or bulk methods for dealing with waste and rejected ammunition destroy the whole cartridge, including its reusable portions. The volume of waste is thus greater than necessary. Furthermore, the remains of these techniques, i.e., the entire cartridge, must be handled and disposed of as comingled hazardous waste, owing to the inclusion of the propellant and/or primer material.

Other tools and methods serve to separate the projectile 12 from the casing 14. These generally do this by grasping both the projectile 12 and the casing 14, and applying a mechanical force to drive them apart. Particularly as concerns the projectile 12, this grasping damages the exterior of the projectile 12, therefore precluding its reuse. On the other hand, there exists one or more implementations of so-called "inertia hammers" that can function only grasping the cartridge 10 by the casing 14. Thereafter applying a swift blow of force, they employ the inertia of the projectile 12 to drive it apart from the casing 14. These tools are, however, too slow and exacting for effectively dealing with large quantities of rejected ammunition in an economically viable manner.

The current state of the art is therefore wanting.

BRIEF SUMMARY OF THE DISCLOSURE

In order to overcome these and other short comings in the known art, provided according to the present disclosure is an apparatus for the intact recovery of ammunition projectiles. The apparatus includes a high pressure fluid cutting device operative to direct a fluid stream to erosively sever the casing of the ammunition cartridge, rearward on the cartridge beyond the rearward extent of the projectile, forming a first half of the cartridge including the projectile and at least a portion of the casing. An automated feeding apparatus collects, orients, and feeds the first halves so severed to a separation press. The separation press includes a press ram, and a brace block. The brace block has a through opening sized to pass the projectile without alteration, and an internal side wall engaging the first half by the portion of the casing.

In a more particular embodiment, the brace block is oriented so the internal side wall engages the portion of the casing such that the rearward extent of the projectile faces the press ram. The press ram is oriented and operative to apply a pressing force to the rearward extent of the projectile over a distance sufficient to separate the projectile from the portion of the casing.

In a more particular embodiment, the separation press is driven by a non-igniting motive power source, and in a still more particular embodiment, a fluid power source. In a more particular embodiment, the brace block is formed in plural and articulable portions. In a more particular embodiment, the brace block includes an additively manufactured polymer material.

In a still more particular embodiment, a first actuator is operative to articulate at least one articulable portion of the brace block. In a still more particular embodiment, the first actuator is driven by a non-igniting motive power source. This may include, without limitation, a fluid power source. In a still more particular embodiment, the separation press and the first actuator may share a power source. In those embodiments where the separation press is driven by a non-igniting and/or fluid power source, the first actuator may share that same non-igniting and/or fluid power source.

Also provided according to the instant disclosure is a method of recovering an ammunition projectile from an ammunition cartridge. The method includes directing a high pressure fluid stream to sever the casing of the ammunition cartridge rearward on the cartridge beyond the rearward extent of the projectile. This forms a first half of the cartridge including the projectile and at least a portion of the casing. The severed first half is thereafter oriented for presentation to a separation press. The first are placed halves into a brace block of the separation press, with the brace block having a through opening therein sized to pass the projectile without alteration thereof. The press block engages the first half by the portion of the casing. A pressing force is applied to the first half by contacting a rearward extent of the projectile, until the projectile separates from the portion of the casing.

In a more particular embodiment of the present disclosure, a plurality of such ammunition cartridges are uniformly oriented for seriatim presentation to the high pressure fluid stream.

In another more particular embodiment, a vibratory bowl feeder is employed to orienting a plurality of the severed first halves for presentation to the separation press.

In another more particular embodiment, the press block includes a plurality of articulable portions.

In another more particular embodiment, the press block is formed using an additively manufactured polymer material. In another more particular embodiment, the pressing force is applied using a non-igniting motive power source. In a still more particular embodiment, the non-igniting motive power source is a fluid power source.

BRIEF DESCRIPTION OF DRAWINGS

These and other features, benefits, and advantages of the present disclosure will be made apparent with reference to the following detailed description, appended claims, and accompanying figures, wherein like reference numerals refer to like structures across the several views, and wherein:

DETAILED DESCRIPTION OF THE DISCLOSURE

A very common form of a projectile 12 is full metal jacketed, or so-called "ball", ammunition. In ball ammunition, the projectile 12 is most commonly a lead core surrounded by a copper jacket. Whether ball ammunition or one of several other types, a serviceable projectile 12 may be rejected due to a defective and/or deformed casing 14. In other cases, it may be desired to "demilitarize", i.e., render safe and inert, unfired ammunition that is deemed unsafe for example due to deterioration cause by extended and/or improper storage. In these, or any other number of other cases, where the projectile 12 is undamaged, it can be reused in manufacturing a new cartridge 10, if the projectile 12 can be extracted from its existing cartridge without itself being subjected to damage or alteration. Additionally, the casing 14 may commonly be formed of brass. Brass can be remelted and reused in any variety of applications, including making new casings 14. The instant disclosure proposes tools and techniques to effectively and efficiently separate a projectile 12 from its casing 14 to facilitate reuse of the former and recycling of the latter.

Figure 1:
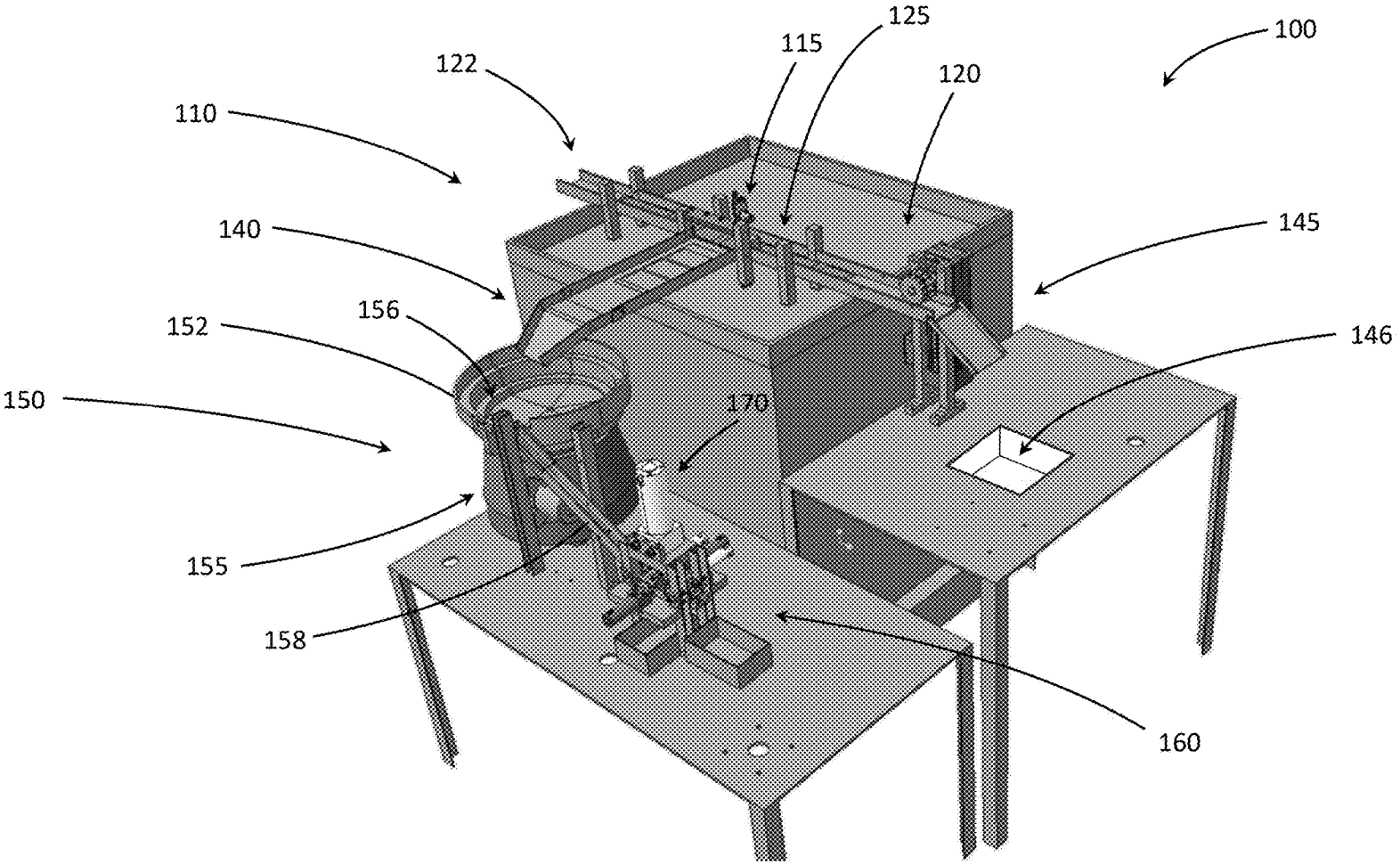
FIG. 1 illustrates schematically, from an overhead perspective view, a non-destructive projectile recovery apparatus according to one embodiment of the instant disclosure.

Referring now to FIG. 1, illustrated schematically from an overhead perspective view is a non-destructive projectile recovery apparatus, generally 100, according to one embodiment of the instant disclosure. The recovery apparatus 100 includes a fluid cutting section 110. The fluid cutting section may be embodied as a so-called "water jet" cutter, as are generally known in the art. Such a water jet cutter is a material subtraction forming method employing controlled fluid erosion. It is particularly well adapted for use in the recovery apparatus 100. Given the flammable and/or explosive propellant material, heat and sparks cannot be tolerated in the disassembly of cartridges. A water jet cutter does not generate the same level of heat produced by conventional cutting methods. Moreover, the fluid employed by a water jet serves to dissipate any heat that is generated at the cutting site. The fluid stream does not pose the risk of sparks that a metal-to-metal cutting method presents.

A pump (not shown) delivers fluid at a high pressure to a cutting nozzle 115. The fluid may optionally include a suspended abrasive grit to enhance its cutting ability. The cutting nozzle 115 directs a stream of this high-pressure fluid onto a workpiece, removing material from the workpiece by erosion. Spent fluid is collected by a collecting basin 120 that underlies the nozzle 115 and the workpiece. Spent fluid may be subject to filtration and treatment, including separation of any abrasive grit material, as by centrifugal action or the like, before the fluid and optionally any abrasive grit material are thereafter recycled in the apparatus 100.

In the presently disclosed recovery apparatus 100, the workpiece is any one of a number of rejected cartridges 130 (See, FIG. 2) to be recycled. These rejected cartridges 130 are preferably introduced into the recovery apparatus 100 at a first end 122 of a holding rail assembly 125. The rejected cartridges 130 are introduced in a like orientation on the rail assembly 125, and are held by the rail assembly 125 from opposite ends of the cartridges 130, allowing the stream of cutting fluid the act on the rejected cartridges 130 and thereafter to pass through to the collecting basin 120. The rail assembly 125 also serves to hold the workpiece above the collecting basin 120. Increasing the distance from the cutting nozzle 115 to the collecting basin 120 minimizes the chance of inadvertent erosion of the collecting basin 120 itself by the high-pressure fluid stream.

Figure 2:
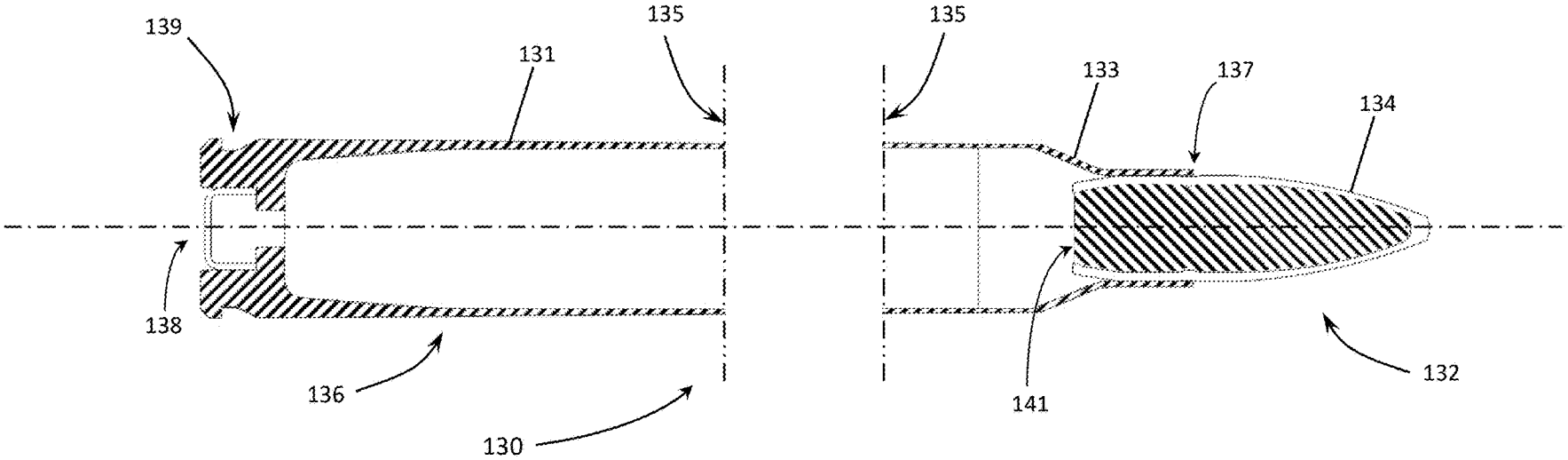
FIG. 2 depicts a rejected cartridge in two parts as severed by the recovery apparatus, in a longitudinal cross-section.

Further operation of the recovery apparatus 100 will be described in light of FIG. 2, which depicts a rejected cartridge 130 in a longitudinal cross-section, and in two parts as severed by the recovery apparatus 100. The cutting nozzle 115, in coordination with the rail assembly 125, directs a cutting stream to sever the rejected cartridges 130 beneath the cutting nozzle 115. The location of the severance line 135 is specifically selected according to the nature of the rejected cartridge 130. Specifically, the rejected cartridge 130 is severed in such a way that the cutting fluid does not alter the projectile 134. The exact location on any given cartridge will depend upon the particular characteristics of the cartridge. Most typically, the rejected cartridge 130 is presented to the cutting nozzle 115 to be cut completely through the casing 131 in a straight line that avoids any contact with the projectile 134. This leaves a first half 132 that includes the projectile 134 and, in the case of the particular caliber of cartridge 130, a shoulder portion 133 of the casing 131. In the case where the caliber of cartridge 130 lacks a specific pronounced shoulder portion 133, the shoulder portion 133 characterized by a prominent and/or discontinuous change in diameter, nonetheless at least some portion of the casing 131 will remain secured to the projectile 134 at the open end 137 of the casing 131. In either case, the shoulder portion 133 of the casing 131 associated with the first half 132 will extend longitudinally rearward, i.e. towards the second half 136, beyond a trailing end 141 of the projectile 134.

After severing the rejected cartridge 130, the first half 132 including the projectile 134 is directed by the rail assembly 125 to be ejected from the fluid cutting section 110 via a first outlet 140 to a feeder section 150 of the apparatus 100. These first halves 132 are allowed to accumulate in a first collection bowl 152. The second half 136 of the rejected cartridge 130, that being the half including the primer 138 and/or the extractor groove 139, is directed by the rail assembly 125 to a second outlet 145 from cutting section 110. These second halves 136 are collected, e.g., at second collection bowl 146, for further processing.

For further processing, the first haves 132 must have the projectile 134 separated from the shoulder portion 133. In a more particular embodiment of the recovery apparatus 100, the feeder section 150 includes the first collection bowl 152 formed as part of a vibratory bowl feeder 155. The vibratory bowl feeder 155 applies an oscillatory motion to the first collection bowl 152. This oscillatory motion of the collection bowl 152 generates a generalized random motion among the constituent first halves 132 within the first collection bowl 152. A series of projections and/or recesses 156 are formed along the inner side walls of the first collection bowl 152, specific to the size and caliber of the first halves 132. The randomized motion of the first halves 132 interacting with the projections and/or recesses 156 serves to align and orient the first halves 132 in a consistent orientation, and to propel the first halves 132 so aligned, along a channel leading to the feed tube 158. Having the first halves 132 presented for separation in a consistent and predictable orientation facilitates separation of the projectile 134 from the shoulder section 133 by automated means, making the endeavor far more economically viable.

Figure 3:
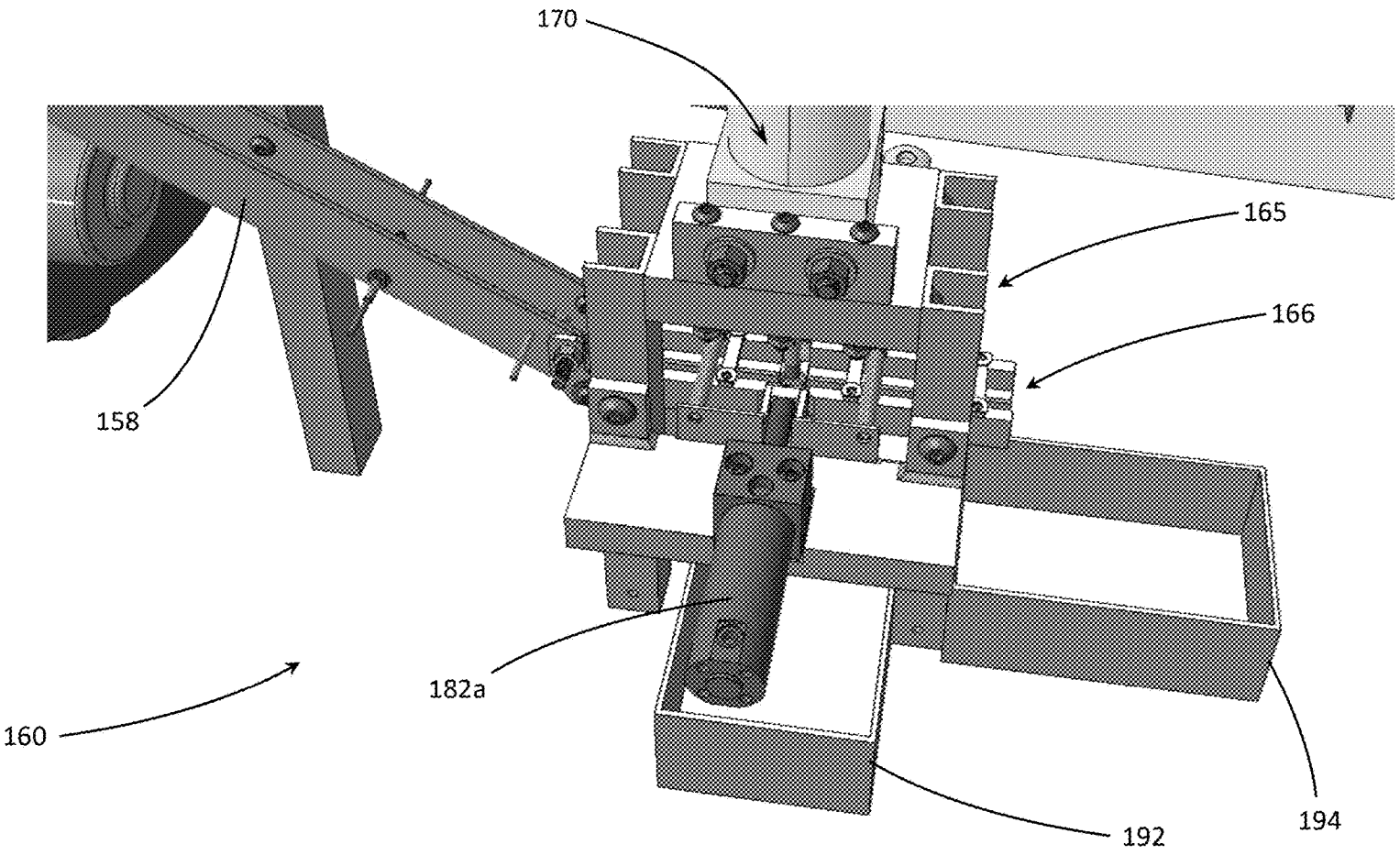
FIG. 3 illustrates a perspective view of an enlargement of the press section of the recovery apparatus, and particularly the separation press, according to one embodiment of the present disclosure.
Figure 3A:
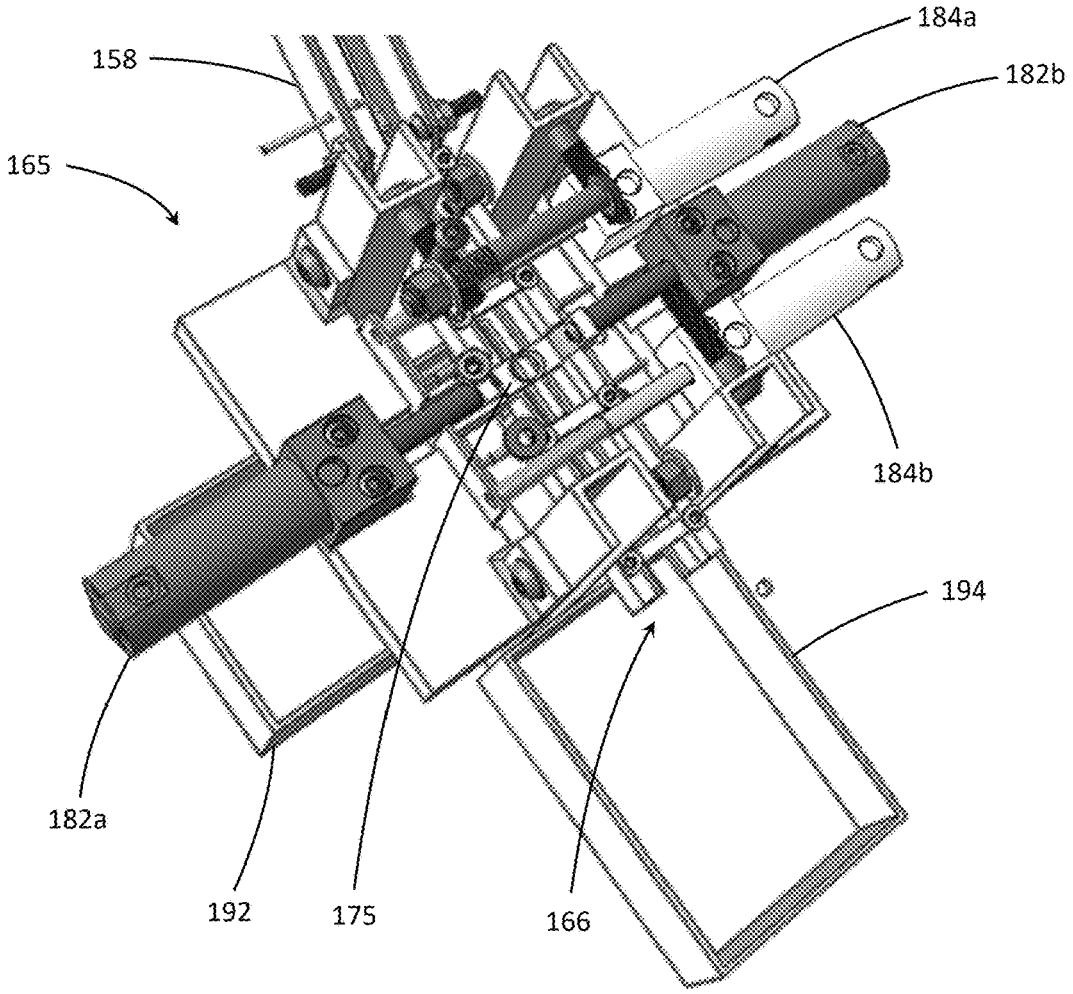
FIG. 3A illustrates an overhead section view of the press section of the recovery apparatus, particularly those parts beneath the separation press, according to one embodiment of the present disclosure.

Referring now to FIG. 3, illustrated in a perspective view is an enlargement of the press section 160. The primary component of the press section 160 is the separation press 165. Appropriately oriented first halves 132 are fed from feed tube 158 into the separation press 165. The separation ram 170 includes, in this embodiment, a fluid-driven piston-and-rod device. The separation ram 170 engages a first half 132 that is placed aligned with the axis of movement of the separation ram 170. More specifically, the separation ram 170 engages the projectile 134 at its trailing end 141.

Figure 4:
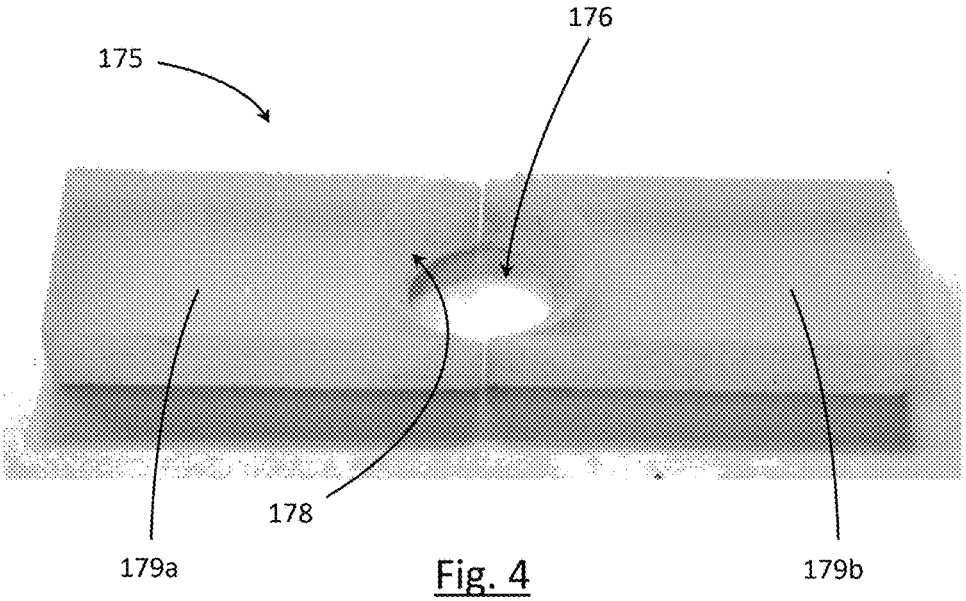
FIG. 4 illustrates a perspective view of a brace block as used in a separation press of the recovery apparatus according to one embodiment of the present disclosure.

The advancing separation ram 170 presses the first half 132 into a brace block 175, an example of which is depicted in FIG. 4. The brace block 175 has a through opening 176, the through opening 176 being sized to pass the projectile 134, and also an interior side wall 178. The interior side wall 178 specifically bears on the shoulder portion 133 of the first half 132, and prevents the shoulder portion 133 from passing through the opening 176. In such embodiments where the casing 131 lacks any pronounced shoulder portion 133, the through opening 176 and interior side wall 178 will be sized to engage that portion of the casing 131 as remains with the first half 132 by the open end 137. In either case, the brace block 175 will act on the casing 131, to avoid damage to the projectile 134, particularly where it is engaged by the casing 131, i.e., at open end 137.

Having separated the projectile 134 from the shoulder portion 133, these are collected separately for further processing. For example, projectiles 134 may be gathered beneath the separation press 165, and press ram 170, in projectile collection bin 192. Projectiles 134 may, after suitable inspection, be reused in making new cartridges. Scrap metal, e.g., brass, from shoulder portion 133 may be ejected via a side exit 166 of the separation press 165, for collection in a suitable scrap collection bin 194. The scrap of shoulder portion(s) 133 may be melted and recycled, including into new casings.

In certain embodiments, the brace block 175 can be machined from metal stock. In other embodiments, the brace block may be formed using additive manufacturing techniques, including as a material nylon, ABS (acrylonitrile butadiene styrene), PET (polyethylene terephthalate glycol), and/or TPU (thermoplastic polyurethane), without limitation. Alternately or additionally, in some more refined embodiments, the brace block 175 may be formed in multiple parts, e.g., first and second parts 179*a*, 179*b*, respectively. In so doing, the respective parts 179*a*, 179*b* may be manipulated independently, for example by corresponding and opposed first and second brace actuators 182*a*, 182*b*, respectively. By adjusting the distance between the first and second parts 179*a*, 179*b*, using first and second brace actuators 182*a*, 182*b*, the size of the through opening 176 may be customizable, for example to accept multiple calibers of cartridge, and/or for fine tuning adjustment in use, as in response to wear of the interior side wall 178.

In a more particular embodiment, first and second gate actuators 184*a*, 184*b* are provided. The first gate actuator 184*a* controls access to the press section 160 by projectile portions 132 being fed to the separation press 165 from feed tube 158 on the one hand. Correspondingly, second gate actuator 184*b* controls access of the scrap shoulder portions 133 from separation press 165 via side exit 166.

At the presently described state of the recovery process, the rejected cartridges 130, and both the first half 132 and second half 136 thereof, are considered hazardous material, owing at least to the presence of propellant material not yet adequately abated. For this reason, it is advantageous that the separation ram 170, actuators 182*a*, 182*b*, etc., are fluid-powered, e.g., pneumatic, hydraulic, or the like. Using motive power transmitted via an inert fluid allows the space in which the recovery apparatus 100 operates to be devoid of a potential source of ignition, for example, electric current, thereby enhancing safety.

Figure 5:
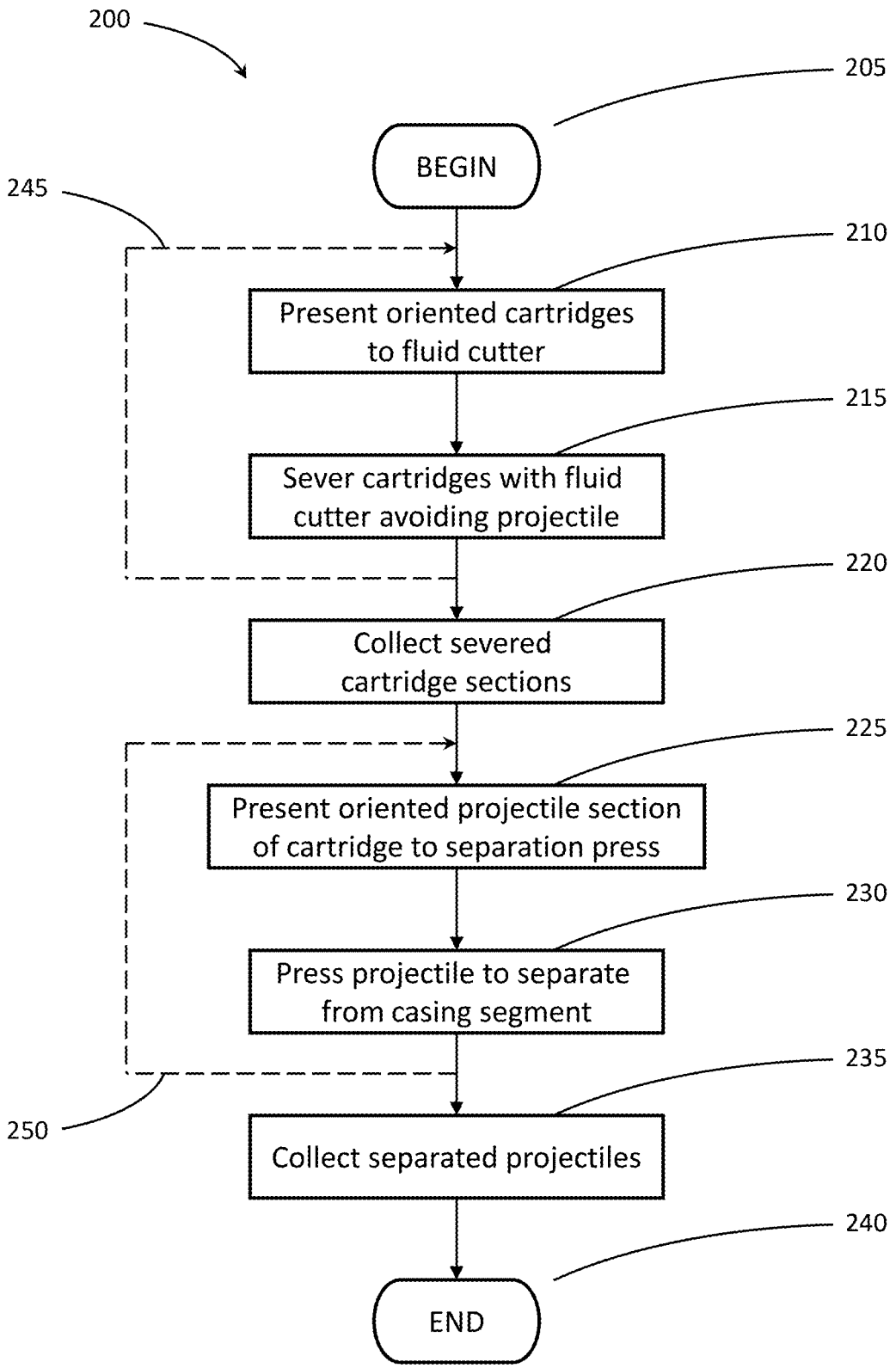
FIG. 5, illustrates a flowchart diagram of a process for non-destructive projectile recovery according to one embodiment of the present disclosure.

Referring now to FIG. 5, illustrated is a flowchart diagram of a herein disclosed process, generally 200, for non-destructive projectile recovery. The process 200 is initiated at step 205. Rejected cartridges 130, oriented similarly, are presented to a fluid cutting section 110. The fluid cutting section is positioned and oriented, relative to the cartridges 130, to sever the cartridge 130, step 215, into at least a first half 132 and a second half 136. It is noted that these halves 132, 136, though called as such for convenience, need not be equal in any relevant dimension. The first half 132 of the severed cartridge will include the projectile 134 and any portion of the casing 131 that secures the casing 131 and the projectile 134 together. In some embodiments, specifically certain calibers of ammunition, said portion of the casing 131 includes shoulder portion 133 where one is included in the cartridge 130. The severance line 135 will be intentionally located on the cartridge 130 to avoid any contact, damage, or alteration to the projectile 134. Having been severed, the first and second halves 132, 136 are collected, step 220, in certain embodiments, collected separately or distinctly.

While the process 200 is, in certain embodiments, continuously carried out, steps 210, 215 and 22 may, in certain embodiments, be carried out by an apparatus 100 as described herein including a cutting section 110. In that case, the severed first and second halves 132, 136 may be discharged from the cutting section 110 for collection at other portions of said apparatus 100. Meanwhile, additional cartridges 130 are presented to the cutting section 110. This is indicated by the dashed line representing cutting subprocess 245.

Further processing of the first halves 132 is required to extract the projectile 134 from that portion of the casing 131 to which it remains attached. This is generally indicated by the dashed line representing a separation subprocess 250. Of the collected first halves 132, these are oriented and presented, step 225, to a separation press 165. The separation press 165 operates on these projectile portions to separate the projectile 134 from the casing segment, step 230, without grasping the projectile 134 in order to avoid any contact, damage, marring or alteration to it. Having been separated, the projectiles 134, and optionally the casing portions, are collected, separately, for further processing, step 235. With allowance for the intended repetition of the separation subprocess 250, to the extent that the supply of cartridges 130 to be recovered and/or first half 132 projectile portions including those cartridges 130 is exhausted, the process 200 terminates at step 240.

Figure 6:
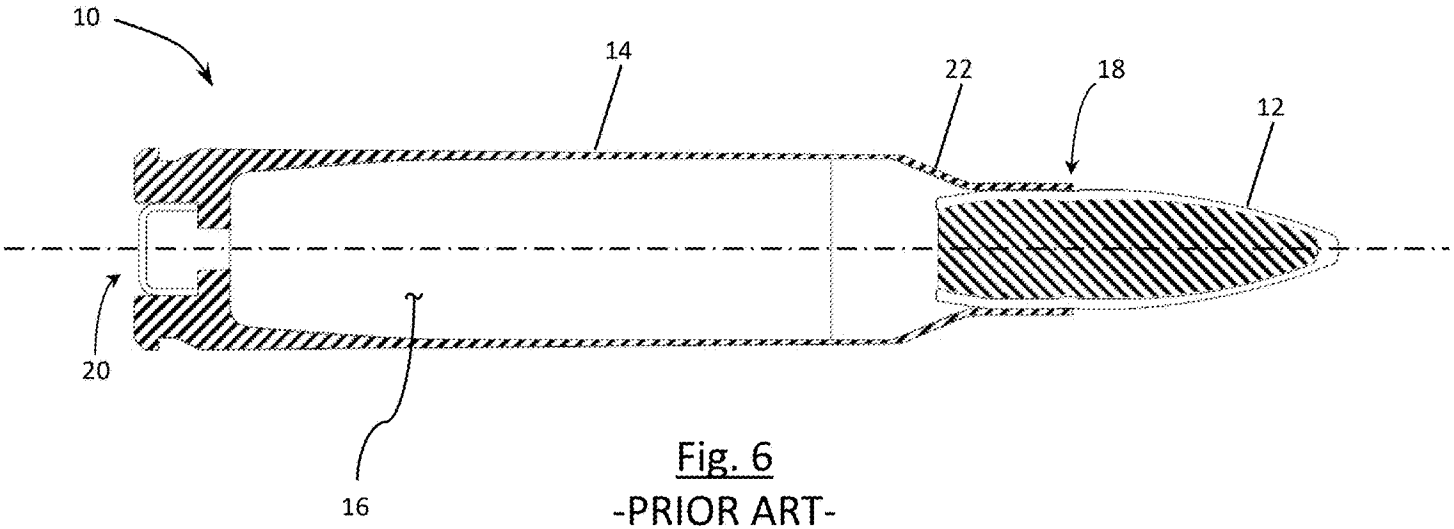
FIG. 6 illustrates an archetypical ammunition cartridge, in a longitudinal cross-section, according to the known prior art.

The present disclosure has been described herein with reference to certain exemplary and/or preferred embodiments. In particular, the illustrative cartridge 10 depicted in FIG. 6, and also in other figures, will be recognizable by those skilled in the art as having proportionate sizing corresponding with cartridges built to 5.56×45 mm NATO caliber. This particular caliber is selected and described merely as a matter of convenience. It will be readily appreciated by those skilled in the art, having been apprised of the instant disclosure, that the disclosure herein can readily be modified, adapted and/or applied to other weapon platforms, sizes, calibers, etc., without departing from the inventive scope thereof. No limitation as to size, configuration, or caliber is intended, nor shall any be implied. These embodiments are offered as merely illustrative, and not limiting, of the scope of the present disclosure. For example, and without limitation, the present disclosure is applicable to any number of weapon platforms, sizes, calibers, etc. The full scope of Applicant's invention is defined solely with reference to the following appended claims.

Table recited elements and reference numerals:

| | |
|---|---|
| 10 | Ammunition cartridge |
| 12 | Projectile |
| 14 | Casing |
| 16 | Cavity |
| 18 | Open end, casing |
| 20 | Primer |
| 22 | Shoulder |
| 100 | Non-destructive projectile recovery apparatus |
| 110 | Fluid cutting section |
| 115 | Cutting nozzle |
| 120 | Collecting basin |
| 122 | First end, holding rail ass'y |
| 125 | Holding rail ass'y |
| 130 | Rejected cartridge |
| 131 | Casing, rejected cartridge |
| 132 | First half, rejected cartridge |
| 133 | Shoulder portion |
| 134 | Projectile, rejected cartridge |
| 135 | Severance line |
| 136 | Second half, rejected cartridge |
| 137 | Open end |
| 138 | Primer, rejected cartridge |
| 139 | Extractor groove, rejected cartridge |
| 140 | First outlet, fluid cutting section |
| 141 | Trailing end, projectile |
| 145 | Second outlet, fluid cutting section |

-continued

Table recited elements and reference numerals:

| | |
|---|---|
| 146 | Second collection bowl |
| 150 | Feeder section |
| 152 | First collection bowl |
| 155 | Vibratory bowl feeder |
| 156 | Projections/recesses |
| 158 | Feed tube |
| 160 | Press section |
| 165 | Separation press |
| 166 | Side exit, separation press |
| 170 | Separation ram |
| 175 | Brace block |
| 176 | Through opening |
| 178 | Side wall |
| 179a | First part, brace block |
| 179b | Second part, brace block |
| 182a | First brace actuator |
| 182b | Second brace actuator |
| 184a | First gate actuator |
| 184b | Second gate actuator |
| 192 | Projectile collection bin |
| 194 | Scrap collection bin |
| 200 | Non-destructive projectile recovery process |
| 205 | Initiation |
| 210 | Present oriented cartridges |
| 215 | Sever cartridges |
| 220 | Collect severed cartridge pieces |
| 225 | Present oriented projectile portions |
| 230 | Separate projectile |
| 240 | Termination |
| 245 | Cutting subprocess |
| 250 | Separation subprocess |

The invention claimed is:

1. An apparatus for the intact recovery of ammunition projectiles, the apparatus comprising: a high pressure fluid cutting device operative to direct a fluid stream to erosively sever a casing of an ammunition cartridge, rearward on the cartridge beyond the rearward extent of the projectile, forming a first half of the cartridge including the projectile and at least a portion of the casing; an automated feeding apparatus collecting therein, orienting, and feeding therefrom a plurality of said first halves so severed; and a separation press, the separation press including a press ram, and a brace block having a through opening therein sized to pass the projectile without alteration thereof, and an internal side wall engaging the first half by the portion of the casing.

2. The apparatus according to claim 1, further comprising: the brace block being oriented so the internal side wall engages the portion of the casing such that the rearward extent of the projectile faces the press ram, and the press ram oriented and operative to apply a pressing force to the rearward extent of the projectile a distance sufficient to separate the projectile from the portion of the casing.

3. The apparatus according to claim 1, further comprising: the separation press being driven by a non-igniting motive power source.

4. The apparatus according to claim 3, further comprising: the non-igniting motive power source including a fluid power source.

5. The apparatus according to claim 1, further comprising: the brace block being formed in plural and articulable portions.

6. The apparatus according to claim 5, further comprising: a first actuator operative to articulate at least one articulable portion of the brace block.

7. The apparatus according to claim 6, further comprising: the first actuator being driven by a non-igniting motive power source.

8. The apparatus according to claim 7, further comprising:

the non-igniting motive power source including a fluid power source.

9. The apparatus according to claim 5, further comprising:

the separation press and the first actuator sharing a power source.

10. The apparatus according to claim 1, further comprising:

said press block comprising an additively manufactured polymer material.

11. A method of recovering an ammunition projectile from an ammunition cartridge, the method comprising:

directing a high pressure fluid stream to sever the casing of the ammunition cartridge rearward on the cartridge beyond the rearward extent of the projectile, forming a first half of the cartridge including the projectile and at least a portion of the casing;

orienting said severed first half for presentation to a separation press;

placing one or more of said first halves into a brace block of the separation press, the brace block having a through opening therein sized to pass the projectile without alteration thereof, the press block engaging the first half by the portion of the casing; and applying a pressing force to said first half by contacting a rearward extent of the projectile, until the projectile separates from the portion of the casing.

12. The method according to claim 11, further comprising:

orienting a plurality of ammunition cartridges uniformly for seriatim presentation to the high pressure fluid stream.

13. The method according to claim 11, further comprising:

orienting a plurality of said severed first halves using a vibratory bowl feeder for presentation to the separation press.

14. The method according to claim 11, further comprising:

providing said press block in a plurality of articulable portions.

15. The method according to claim 11, further comprising:

forming said press block using an additively manufactured polymer material.

16. The method according to claim 11, further comprising:

applying said pressing force using a non-igniting motive power source.

* * * * *